US012130107B2

(12) United States Patent
Schrödl

(10) Patent No.: US 12,130,107 B2
(45) Date of Patent: Oct. 29, 2024

(54) BUFFER RETAINER

(71) Applicant: SAKO OY, Riihimäki (FI)

(72) Inventor: Christoph Schrödl, Porvoo (FI)

(73) Assignee: SAKO OY, Riihimäki (FI)

( * ) Notice: Subject to any disclaimer, the term of this patent is extended or adjusted under 35 U.S.C. 154(b) by 0 days.

(21) Appl. No.: 17/925,210

(22) PCT Filed: Apr. 30, 2021

(86) PCT No.: PCT/FI2021/050325

§ 371 (c)(1),
(2) Date: Nov. 14, 2022

(87) PCT Pub. No.: WO2021/234215

PCT Pub. Date: Nov. 25, 2021

(65) Prior Publication Data

US 2023/0228506 A1 Jul. 20, 2023

(30) Foreign Application Priority Data

May 20, 2020 (FI) ..... 20205512

(51) Int. Cl.
*F41A 3/84* (2006.01)
*F41A 3/66* (2006.01)

(52) U.S. Cl.
CPC . *F41A 3/84* (2013.01); *F41A 3/66* (2013.01)

(58) Field of Classification Search
CPC ..... F41A 3/84
USPC ..... 89/198; 42/1.06
See application file for complete search history.

(56) References Cited

U.S. PATENT DOCUMENTS

| | | | |
|---|---|---|---|
| 8,991,088 | B1 | 3/2015 | Young |
| 2016/0209137 | A1 | 7/2016 | Desomma |
| 2018/0274871 | A1 | 9/2018 | Leitner-Wise et al. |
| 2019/0056188 | A1 | 2/2019 | Miller |

OTHER PUBLICATIONS

International Search Report and Written Opinion in Application No. PCT/FI2021/050325, mailed Jul. 29, 2021, 13 pages.
Search Report in Finnish Application No. 20205512, dated Nov. 20, 2020, 1 page.

*Primary Examiner* — Reginald S Tillman, Jr.
(74) *Attorney, Agent, or Firm* — Meunier Carlin & Curfman LLC

(57) ABSTRACT

Buffer retainer, which buffer retainer comprises a body portion having an upper surface, and a retainer tab extending from the upper surface of the body portion, wherein the cross-sectional area of the retainer tab is smaller than the cross-sectional area of the body portion, wherein the body portion is configured to be set in a hole formed in a frame piece of a weapon, and wherein the retainer tab is configured to extend above surface of the frame piece via a channel to restrict movement of a buffer of the weapon, which channel extends between the end surface of the hole and the said surface of the frame piece, and which channel has smaller diameter than the said hole. The invention also relates to a buffer retainer system utilizing such a buffer retainer.

5 Claims, 4 Drawing Sheets

BUFFER RETAINER

CROSS REFERENCES

This application is a U.S. national stage application of international application number PCT/FI2021/050325 filed on Apr. 30, 2021 and claiming priority of Finnish national application number F120205512 filed on May 20, 2020.

FIELD OF THE INVENTION

The present invention relates to a buffer retainer for an automatic or semi-automatic weapon with a buffer system, which buffer retainer keeps the buffer inside a buffer tube when the weapon is dismantled.

BACKGROUND OF THE INVENTION

Buffer systems in weapons, such as automatic or semi-automatic rifles for example, are designed to work together and assist a bolt carrier when it moves during the operation of the weapon. The buffer systems are typically formed and connected to the rear end of a lower receiver of the weapon, wherein the buffer contacts the rear end of the bolt carrier. When the weapon is fired, or loaded before firing, the buffer moves first backwards with the bolt carrier and then pushes the bolt carrier forward, which back- and forth movement typically achieves the required bolt action of an automatic or semi-automatic rifle.

The buffer system typically comprises a buffer tube, which is closed at rear end and open at front end, the buffer itself, and a spring, and the buffer with the spring are inside the buffer tube so, that the spring is located at least partially between the buffer and the closed end of the buffer tube. The buffer tube is typically connected to a rear of a lower receiver of a weapon via an opening formed in the lower receiver for the buffer tube with a threaded connection. The lower receiver is also equipped with a buffer retainer, which is typically a movable pin extending from the surface of the opening formed in the rear receiver for the buffer tube, and which buffer retainer prevents the spring loaded buffer to exit from the buffer tube.

The buffer retainer is typically located in a hole formed in the rear portion of the lower receiver. The hole opens partially in the area, or close to the edge of the area, of the fixing surface formed in the rear receiver for fixing the buffer tube, which fixing surface is typically formed with threading. The buffer retainer is formed as a longitudinal cylindrical piece having a smaller diameter section and a larger diameter section and a circular beveled shoulder between the sections. In the hole between the bottom of the hole and the buffer retainer is placed a spring. After the spring and the buffer retainer are placed in the hole, the buffer retainer is pushed downwards and the buffer tube is moved partially cover the hole so, that the beveled shoulder is at least partially under the edge of the buffer tube. Now, when the buffer retainer is released, the beveled collar sets against the edge of the buffer tube and the smaller diameter section extends over the thickness of the buffer tube wall to prevent the buffer located inside of the buffer tube from moving out of the buffer tube.

SUMMARY OF THE INVENTION

The present invention provides a novel buffer retainer, which maintains its position in the rear receiver when the weapon is dismantled. Further, the present invention provides buffer retainer and buffer retainer system which is easy to assemble in the lower receiver of the weapon and wherein the channels formed for the buffer retainer system does not collect dirt so easily as the prior art solutions. The present invention also allows for more compact structure of the lower receiver, which lowers the overall weight of the weapon itself.

The buffer retainer of the present invention comprises a body portion having an upper surface, and a retainer tab extending from the upper surface of the body portion, wherein the cross-sectional area of the retainer tab is smaller than the cross-sectional area of the body portion, wherein the body portion is configured to be set in a hole formed in a frame piece of a weapon, and wherein the retainer tab is configured to extend above a surface of the frame piece via a channel to restrict movement of a buffer of the weapon, which channel extends between the end surface of the hole and the said surface of the frame piece, and which channel has smaller diameter than the said hole.

This allows the buffer retainer to be inserted in the hole in the frame piece of the weapon via other surface of the frame piece than the surface that the retainer tab extends upwards, which allows easier assembly of the buffer retainer in the frame piece. Further, the smaller opening on the surface from which the retainer tab extends also prevents collection of dirt in the channel, since the retainer tab covers substantially greater area of the channel than in the prior art solutions. Also, no spring pin or similar part, which would be installed from the side perpendicular to the channel, is required for keeping the buffer retainer at its place, which effectively eliminates one source of dirt accumulation.

In an embodiment of the buffer retainer of the invention the longitudinal center axis of the body portion and the longitudinal center axis of the retainer tab are parallel but not concentric.

This provides eccentric positioning of the retainer tab on the upper surface of the body portion which helps in the assembly of the buffer retainer in the frame piece and prevents the buffer retainer rotating during the operation of the weapon.

In an embodiment of the buffer retainer of the invention the body portion comprises a recess on the bottom surface of the body portion configured to receive end of a spring.

In an embodiment of the buffer retainer of the invention the retainer tab comprises a bevel on the area configured to extend from the surface of the frame piece of the weapon, which bevel is located on the side configured to be opposite from the side configured to be against the buffer. This bevel area on the retainer tab allows inserting the buffer of the weapon into the buffer tube without separately pushing the buffer retainer downwards, since the movement of the buffer achieves this downward movement of the buffer retainer by pushing against the bevel area.

The present invention also provides a buffer retainer system, which system comprises a buffer retainer and a retainer spring set in a hole formed in a frame piece of a weapon, and wherein the buffer retainer comprises a retainer tab configured to extend above a surface of the frame to restrict movement of a buffer of the weapon, wherein the buffer retainer is a buffer retainer of the invention as defined above, and wherein the frame piece comprises a channel extending between the end surface of the hole and the said surface of the frame piece, and which channel has smaller diameter than the said hole.

In an embodiment of the buffer retainer system of the invention the system comprises a retainer screw for keeping the spring and the buffer retainer inside the said hole.

In an embodiment of the buffer retainer system of the invention the longitudinal center axis of the said hole and the said channel are parallel but not concentric.

In an embodiment of the buffer retainer system of the invention the said hole and the said channel extend substantially perpendicularly in relation to the said surface of the frame piece of the weapon. This is a preferred embodiment, but alternatively the hole and channel can also be formed to extent non-perpendicularly if deemed necessary.

In an embodiment of the buffer retainer system of the invention the opening of the said channel on the said surface of the frame piece is in immediate vicinity of a threaded fixing surface formed in the frame piece for a buffer tube.

More precisely the features defining a buffer retainer in accordance with the present invention are presented in claim 1, and the features defining a buffer retainer system in accordance with the present invention are more precisely presented in claim 5. Dependent claims present advantageous features and embodiments of the invention.

BRIEF DESCRIPTION OF THE DRAWINGS

Exemplifying embodiment of the invention and its advantages are explained in greater detail below in the sense of example and with reference to accompanying drawings, where.

DETAILED DESCRIPTION OF THE INVENTION

Figure 1:
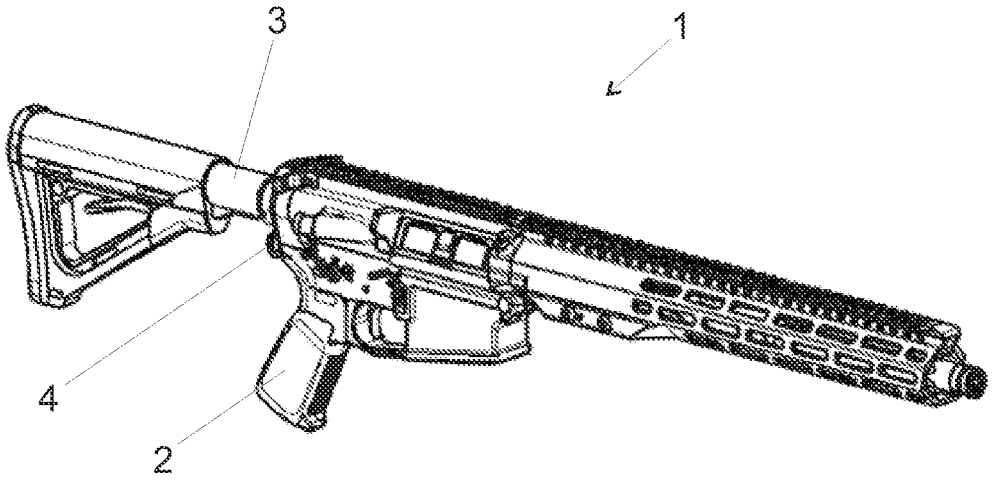
FIG. 1 shows schematically an embodiment of a weapon in which the present invention can be utilized.

FIG. 1 shows schematically an embodiment of a weapon 1 in which a buffer retainer system of the invention can be utilized. The weapon 1 show is an automatic rifle. The main parts of the weapon 1 in the context of the present invention are the area of the pistol grip 2, buffer tube 3, and the frame piece 4 in which the pistol grip 2 and buffer tube 3 are connected, which frame piece is in this embodiment a lower receiver of an AR-type rifle.

Figure 2:
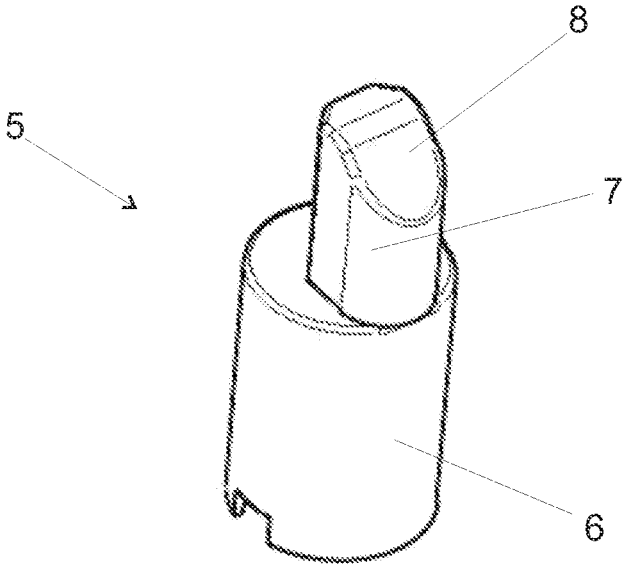
FIG. 2 shows schematically an embodiment of a buffer retainer of the invention.

FIG. 2 shows schematically an embodiment of a buffer retainer 5 of the invention. The buffer retainer 5 comprises a body portion 6, and a retainer tab 7 extending from the top surface of the body portion.

The body portion 6 of the buffer retainer 5 is preferably cylindrical in form, and the retainer tab 7 extending from the top surface of the body portion is located eccentrically on that surface. In other words, the longitudinal center axis of the body portion 6 and the retainer tab are parallel but not concentric. The eccentricity of the retainer tab 7 in relation to the body portion 6 also define the position of the buffer retainer 5 when in is assembled at its place in the frame piece 4 of the weapon 1.

In the upper end area of the retainer tab 7 is formed a bevel 8. When the buffer retainer 5 is assembled at its place in the frame piece 4 of the weapon 1, the bevel will be on the side of the buffer retainer closest to a bolt carrier of the weapon 1.

Figure 3:
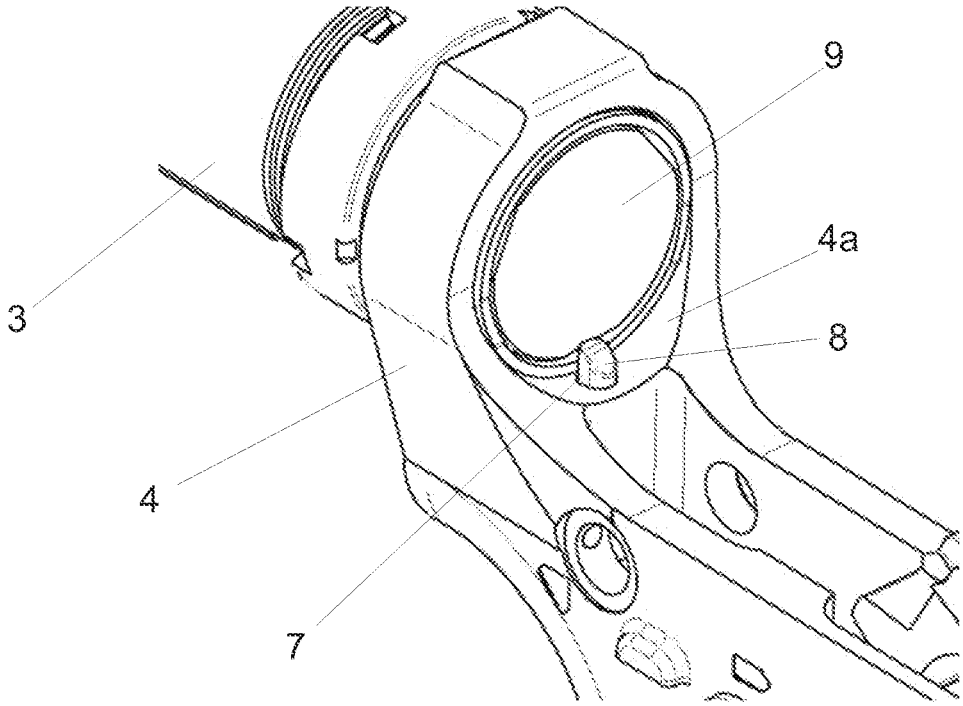
FIG. 3 shows schematically the embodiment of FIG. 2 assembled at its place in a frame piece of a weapon.

FIG. 3 shows schematically the buffer retainer 5 shown in FIG. 2 assembled at its place in a frame piece 4 of a weapon 1. When the buffer retainer 5 is at its place, only the upper part of the retainer tab 7 extends from the surface 4*a* of the frame piece 4, rest of the buffer retainer 5 is located inside the frame piece 4. This outwards from surface 4*a* extending part of the retainer tab 7 also comprises the bevel 8. The opposite side of the retainer tab 7 in relation to the bevel 8 keeps the spring-loaded buffer 9 inside the buffer tube 3.

Figure 4:
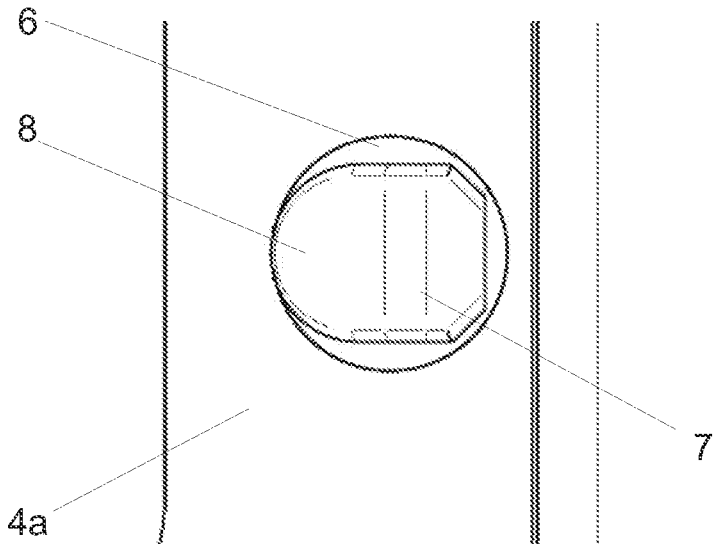
FIG. 4 shows schematically a top view of the embodiment of FIG. 2 at its place.

FIG. 4 shows schematically a top view of the buffer retainer 5 at its place in the frame piece 4, as shown in FIG. 3. The straight surface at the right side of the buffer tab 7 sets against the buffer 9. The eccentric position of retainer tab 7 in the upper surface of the body portion 6 of the buffer retainer 5, together with the related hole and channel formed in the frame piece 4 in corresponding eccentric arrangement, the larger diameter hole for the body portion 6 and the smaller diameter channel for the retainer tab 7, keeps the buffer retainer at its position and prevents it from rotating in the channels during operation of the weapon 1.

Figure 5:
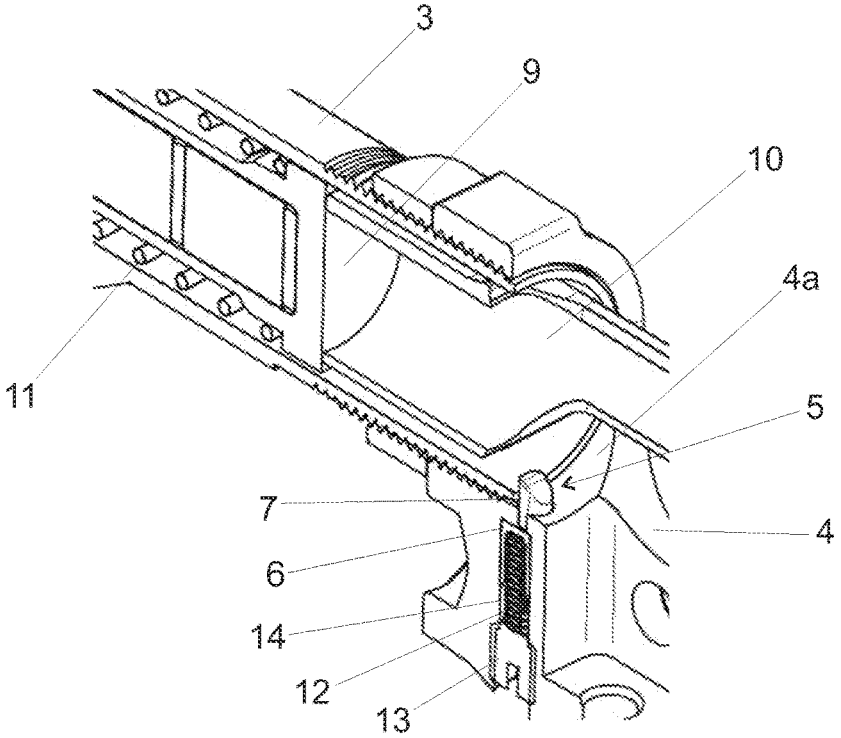
FIGS. 5 and 6 show schematically cross-sectional views of the embodiment of FIG. 2 at its place.
Figure 6:
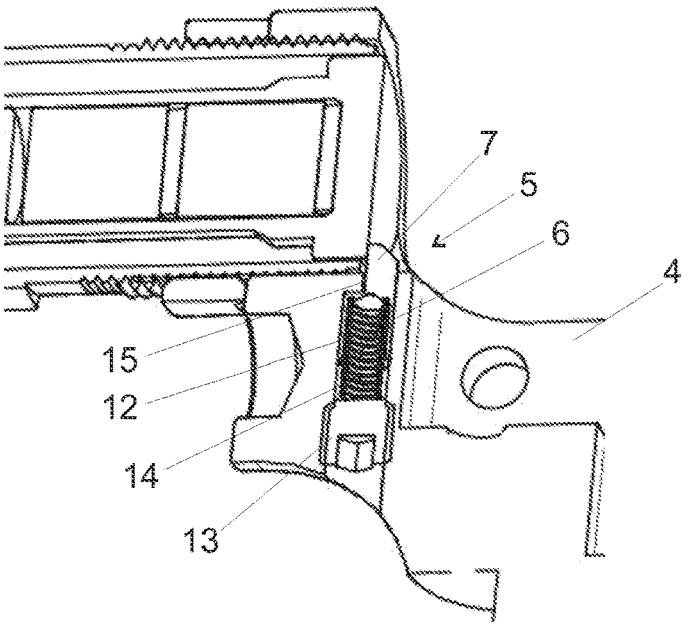

FIGS. 5 and 6 show schematically cross-sectional views wherein the buffer retainer 5 is assembled at its place in the weapon.

FIG. 5 illustrates the situation where a bolt carrier 10 presses against the buffer 9 at its rearmost position due to firing of the weapon or due to manual loading movement of the weapon. In this position the bolt carrier 10 is moved inside the buffer tube 3 and passed the retainer tab 7 of the buffer retainer 5. In the bottom surface of the bolt carrier 10 is formed a continuous groove so that the bolt carrier can pass the retainer tab 7 without contacting it. After the bolt carrier 10 has reached its rearmost position, the buffer spring 11 will push the buffer 9 and the bolt carrier forward, which forward movement of the buffer is stopped with the retainer tab 7 as shown in FIG. 6.

FIGS. 5 and 6 also illustrate the hole and channel formed in frame piece 4 of the weapon for the buffer retainer 5. The larger diameter hole 14 is formed, preferably by drilling, via a surface of the frame piece 4 away from the buffer tube 3, and the hole ends a distance away from the plane of the fixing surface of the buffer tube. The hole 14 houses the body portion 6 of the buffer retainer 5, retainer spring 12, and a retainer screw 13 locking the body portion 6 and the retainer spring 12 inside the hole 14. As can be seen from the cross-sections shown in FIGS. 5 and 6, in the body portion 6 of the buffer retainer 5 is formed a recess at its bottom surface in which recess the first end of the retainer spring 12 is located.

The smaller diameter channel 15 is formed for the retainer tab 7, and the channel extends from the end surface of the hole 14 to the surface 4*a* of the frame piece 4 so, that its opening on the surface 4*a* is located very near the fixing thread for fixing the buffer tube 3 to the frame piece 4.

The hole 14 and the channel 15 are located in relation to each other in this embodiment so, that the side edges of the hole and channel that are the most away from the rear of the frame piece 4 coincide in a point, i.e. form a straight line extending longitudinally along the side surfaces of both the hole and the channel. In this way the channel 15 is completely on the area of the end surface of the hole 14, but at the edge of that area. The center lines of the hole 14 and channel 15 are parallel and preferably substantially perpendicular in relation to the surface 4*a*, but can alternately also be formed non-perpendicularly in relation to the surface 4*a*.

Figure 7:
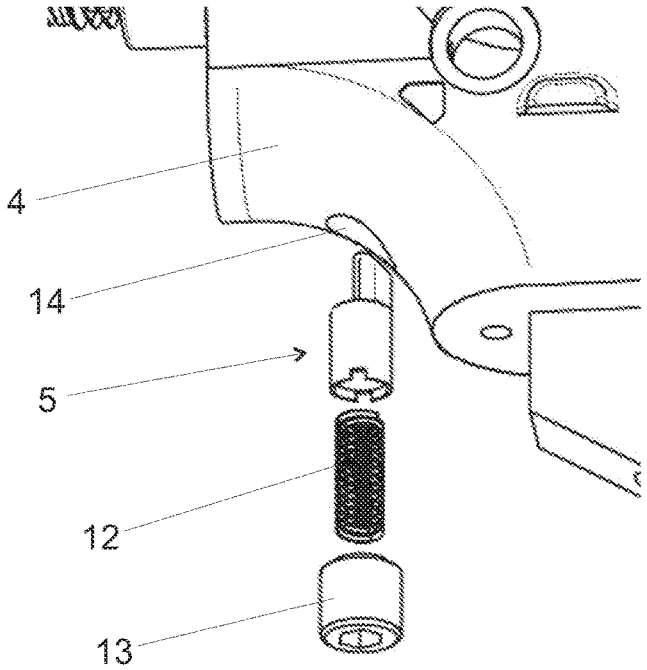
FIG. 7 shows schematically an exploded view of an embodiment of a buffer retainer system of the invention.

FIG. 7 shows schematically an exploded view of the parts of the buffer retainer system, i.e. the buffer retainer 5, retainer spring 12 and the retainer screw 13. When assembled inside the hole 14, the retainer spring 12 keeps the buffer retainer 5 at its place with its spring force, but allows manual pushing of the buffer retainer 5 down if the buffer 9 needs to be removed from the buffer tube 3. The retainer screw 13 has threaded outer surface which allows it to be screwed in the hole 14 via threading formed therein.

Figure 8:
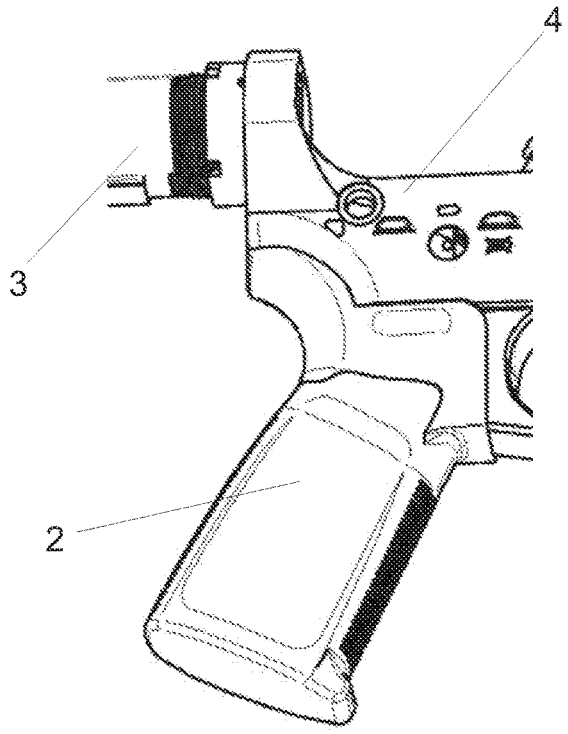
FIG. 8 shows schematically the area of the buffer retainer system of the invention when a pistol grip is connected at its place on the weapon.

FIG. 8 shows schematically how the hole 14 is covered with a pistol grip 2 when the pistol grip is fixed on the frame piece 4. This prevents dirt penetrating and collecting in the area of the retainer screw 13 and the hole 14.

The specific exemplifying embodiment of the invention shown in figures and discussed above should not be construed as limiting. A person skilled in the art can amend and modify the embodiment described in many evident ways within the scope of the attached claims. Thus, the invention is not limited merely to the embodiment described above.

The invention claimed is:

1. A buffer retainer system, which system comprises a frame piece of a weapon, a buffer retainer and a retainer spring set in a hole formed in the frame piece, and wherein the buffer retainer comprises a body portion having an upper surface, and a retainer tab extending from the upper surface of the body portion and configured to extend above a surface of the frame piece to restrict movement of a buffer of the weapon, wherein the frame piece comprises a channel extending between an end surface of the hole and the surface of the frame piece, and which channel has smaller diameter than the hole, and that the retainer tab of the buffer retainer is configured to extend via the channel in the hole.

2. The buffer retainer system according to claim 1, wherein the system comprises a retainer screw for keeping the retainer spring and the buffer retainer inside the hole.

3. The buffer retainer system according to claim 1, wherein a longitudinal center axis of the hole and the channel are parallel but not concentric.

4. The buffer retainer system according to claim 1, wherein the hole and the channel extend substantially perpendicularly in relation to the surface of the frame piece of the weapon.

5. The buffer retainer system according to claim 1, wherein an opening of the channel on the surface of the frame piece is in immediate vicinity of a threaded fixing surface formed in the frame piece for a buffer tube.

* * * * *